US006781477B1

(12) United States Patent
Stancil

(10) Patent No.: US 6,781,477 B1
(45) Date of Patent: Aug. 24, 2004

(54) SYSTEM AND METHOD FOR INCREASING THE CHANNEL CAPACITY OF HVAC DUCTS FOR WIRELESS COMMUNICATIONS IN BUILDINGS

(75) Inventor: Daniel D. Stancil, Mars, PA (US)

(73) Assignee: Carnegie Mellon University, Pittsburgh, PA (US)

( * ) Notice: Subject to any disclaimer, the term of this patent is extended or adjusted under 35 U.S.C. 154(b) by 0 days.

(21) Appl. No.: 10/260,918

(22) Filed: Sep. 30, 2002

(51) Int. Cl.[7] ..... H01P 5/12; H01P 3/00

(52) U.S. Cl. ..... 333/125; 333/249; 333/239

(58) Field of Search ..... 333/248, 239, 333/249, 125; 455/3.1, 6.3

(56) References Cited

U.S. PATENT DOCUMENTS 5,977,851 A * 11/1999 Stancil et al. ..... 333/248
5,994,984 A * 11/1999 Stancil et al. ..... 333/248

OTHER PUBLICATIONS

Aronoff, M. "Radial Probe Measurements of Mode Conversion in Large Round Waveguide with $TE_{01}$ Mode Excitation," p. 301, *IRE National Convention Program,* Mar. 1951.

King, A.P., "Dominant Wave Transmission Characteristics of a Multimode Round Waveguide," pp. 966–969, *Proceedings of the I.R.E.,* Aug. 1952.

Miller, S.E., "Notes on Methods of Transmitting the Circular Electric Wave Around Bends," pp. 1104–1133, *Proceedings of the I.R.E.,* Sep. 1952.

Miller, S.E., and Beck, A.C., "Low–Loss Waveguide Transmission," pp. 348–358, *Proceedings of the I.R.E.,* Mar. 1953.

Miller, S.E., "Waveguide as a Communication Medium," pp. 1209–1265, *The Bell System Technical Journal,* vol. XXXIII, No. 6, Nov. 1954.

Beck, A.C., "Measurement Techniques for Multimode Waveguides," pp. 35–41, *IRE Transactions–Microwave Theory and Techniques,* 1955.

Forrer, Max P. and Tomiyasu, Kiyo, "Determination of Higher Order Propagating Modes in Wave–Guide Systems," pp. 1040–1045, *Journal of Applied Physics,* vol. 29, No. 7, Jul. 1958.

Lewis, D.J., "Mode Couplers and Multimode Measurement Techniques," pp. 110–115, *IRE Transactions on Microwave Theory and Techniques* Jan. 1959.

Price, Vernon G., "Measurement of Harmonic Power Generated by Microwave Transmitters," pp. 116–120, *IRE Transactions on Microwave Theory and Techniques,* Jan. 1959.

Taub, Jesse J., "A New Technique for Multimode Power Measurement," pp. 496–505, *IRE Transactions on Microwave Theory and Techniques,* Nov. 1962.

Levinson, D.S. and Rubinstein, I., "A Technique for Measuring Individual Modes Propagating in Overmoded Waveguide," pp. 310–322, *IEEE Transactions on Microwave Theory and Techniques,* vol. MTT–14, No. 7, Jul. 1966.

(List continued on next page.)

*Primary Examiner*—Robert Pascal
*Assistant Examiner*—Kimberly Glenn
(74) *Attorney, Agent, or Firm*—Kirkpatrick & Lockhart LLP

(57) ABSTRACT

A system for transmitting wireless communications within ductwork. The system includes a plurality of transmitter devices for introducing electromagnetic radiation into the ductwork such that the ductwork acts as a waveguide for the electromagnetic radiation, said transmitter devices comprising a transmitter array, wherein the transmitter devices are configured to introduce the electromagnetic radiation using multiple propagation modes. The system also includes a plurality of receiver devices for detecting the electromagnetic radiation within the ductwork, said receiver devices comprising a receiver array.

22 Claims, 6 Drawing Sheets

OTHER PUBLICATIONS

Lorbeck, J.A. and Vernon R.J., "Determination of Mode Content and Relative Phase in Highly Overmoded Circular Waveguides by Open–End Radiation Pattern Measurement," pp. 1251–1254, *IEEE,* vol. 56, No. 6, 1989.

Baird, J.M., Roper, D.H. and Grow, R.W., "Surface Array Waveguide Mode Analyzer," pp. 137–140, *IEEE MTT–S Digest,* 1992.

Johnston, Ronald H., "Measurement of Modes in an Overmoded Circular Waveguide," pp. 599–602, *IEEE,* 1997.

Glock, H.–W. and van Rienen, U., "An Iterative Algorithm to Evaluate Multimodal S–Parameter–Measurements," pp. 1841–1845, *IEEE Transactions on Magnetics,* vol. 36, No. 4, Jul. 2000.

* cited by examiner

SYSTEM AND METHOD FOR INCREASING THE CHANNEL CAPACITY OF HVAC DUCTS FOR WIRELESS COMMUNICATIONS IN BUILDINGS

BACKGROUND

The present invention is directed generally to wireless signal transmission, and, more particularly, to wireless signal transmission in a building heating, ventilation, and air conditioning (HVAC) system.

The use of HVAC ducts as waveguides for the wireless transmission and distribution of electromagnetic signals within buildings is described in U.S. Pat. Nos. 5,994,984 and 5,977,851 to Stancil et al., which are incorporated herein by reference. Wireless transmission in an indoor environment has the advantage that the building in which transmission is taking place does not have to be fitted with wires and cables that are equipped to carry the transmitted signals. Furthermore, the use of HVAC ducts as wireless communication channels eliminates the need for an elaborate system of transmitters, receivers, and antennas typically associated with traditional indoor wireless communication applications.

SUMMARY

In one embodiment, the present invention is directed to a system for transmitting wireless communications within ductwork. The system includes a plurality of transmitter devices for introducing electromagnetic radiation into the ductwork such that the ductwork acts as a waveguide for the electromagnetic radiation, said transmitter devices comprising a transmitter array, wherein the transmitter devices are configured to introduce the electromagnetic radiation using multiple propagation modes. The system also includes a plurality of receiver devices for detecting the electromagnetic radiation within the ductwork, said receiver devices comprising a receiver array.

In one embodiment, the present invention is directed to a system for transmitting wireless communications within ductwork. The system includes means for introducing electromagnetic radiation into the ductwork such that the ductwork acts as a waveguide for the electromagnetic radiation, said means for introducing comprising a transmitter array, wherein the transmitter array is configured to introduce the electromagnetic radiation using multiple propagation modes. The system also includes means for detecting the electromagnetic radiation within the ductwork, said means for detecting comprising a receiver array.

In one embodiment, the present invention is directed to a method for transmitting wireless communications within ductwork. The method includes introducing electromagnetic radiation into the ductwork using a plurality of transmitter devices such that the ductwork acts as a waveguide for the electromagnetic radiation, said transmitter devices comprising a transmitter array, wherein the transmitter array is configured to introduce the electromagnetic radiation using multiple propagation modes. The method also includes detecting the electromagnetic radiation using a plurality of receiver devices within the ductwork, said receiver devices comprising a receiver array.

BRIEF DESCRIPTION OF THE DRAWINGS

For the present invention to be clearly understood and readily practiced, the present invention will be described in conjunction with the following figures, wherein.

DESCRIPTION

Figure 1:
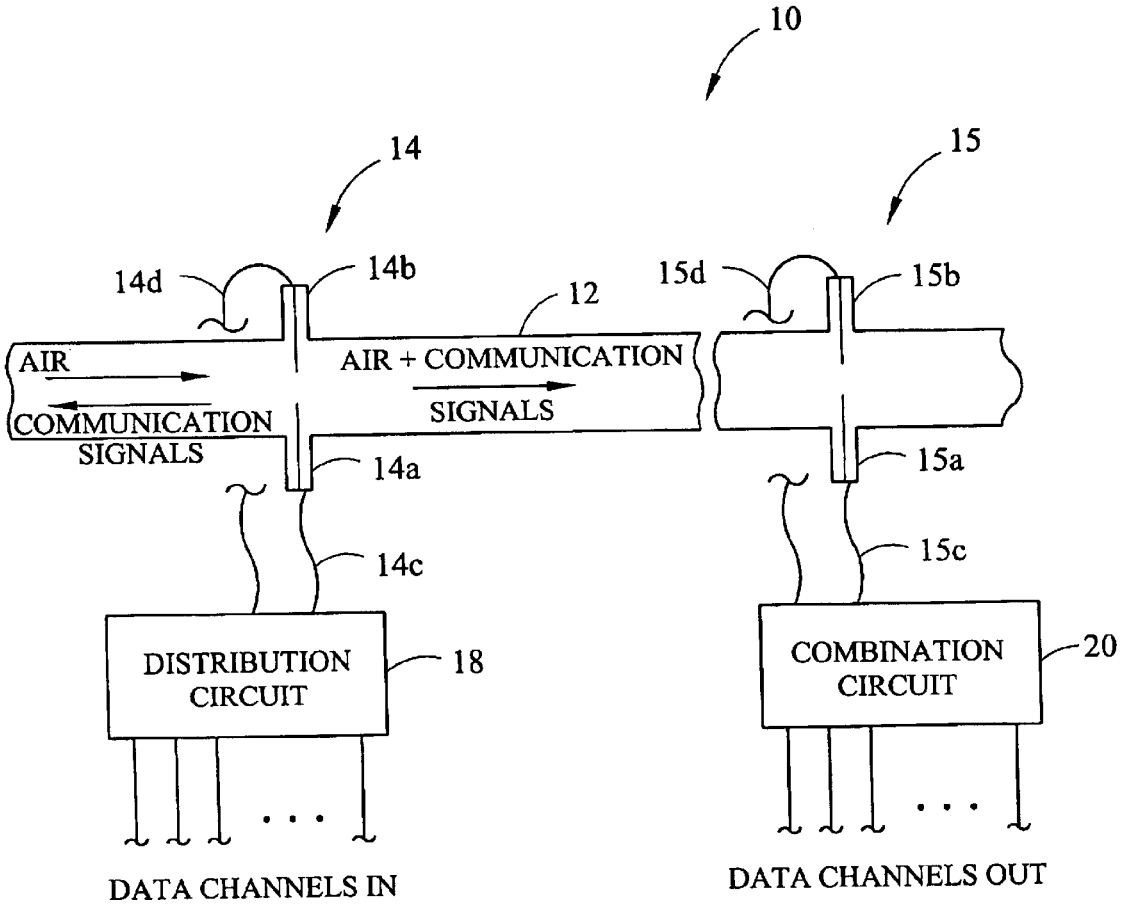
FIG. 1 is a diagram illustrating an embodiment of a wireless HVAC duct transmission system of the present invention.

It is to be understood that the figures and descriptions of the present invention have been simplified to illustrate elements that are relevant for a clear understanding of the present invention, while eliminating, for purposes of clarity, many other elements found in typical HVAC systems and in typical wireless communication systems. Those of ordinary skill in the art will recognize that other elements are desirable and/or required to implement an HVAC system and a wireless communication system incorporating the present invention. However, because such elements are well known in the art, and because they do not facilitate a better understanding of the present invention, a discussion of such elements is not provided herein.

A limiting characteristic of any communication channel is the maximum rate at which data may be transmitted through that channel, referred to as the channel capacity. Although increasing the channel bandwidth can produce a corresponding increase in channel capacity, this approach may not be practical for some applications because of the limited availability of additional spectrum. For this reason, considerable effort has been focused on developing wireless communication architectures that increase channel capacity by maximizing the spectral efficiency of a fixed frequency band. One approach to increase channel capacity has utilized multiple antennas located at both the transmitter and receiver. By utilizing the multipath propagation of wireless signals between transmitter and receiver antennas, several data channels may be supported simultaneously without sacrificing additional bandwidth. Known as spatial multiplexing, this approach has yielded gains in channel capacity up to ten times that of conventional single antenna systems.

Although wireless signals also undergo multipath propagation in waveguides, the use of spatial multiplexing as applied to multipath propagation in free space is not possible. Waveguides used for wireless communication are typically designed for the efficient propagation of a single electromagnetic field configuration, known as the dominant waveguide mode, although waveguides may be designed to operate at modes other than the dominant mode. Because only one waveguide mode is utilized to transmit data at a given frequency, the channel capacity of the waveguide is limited to one data channel.

Unlike conventional waveguide designs, however, the geometry of an HVAC duct may permit the propagation of multiple waveguide modes, and the duct may be modeled as a multimode waveguide at RF and microwave frequencies. Although multimode transmission is frequently used in high power microwave (HPM) research and in applications requiring the transmission of large amounts of power, it is generally disfavored in wireless communication applications where signal distortion is a concern. The distribution of waveguide modes possible in a HVAC duct depends on several variables, including the shape of the duct, as well as the number, type, and position of coupling probes used to inject electromagnetic energy. The energy contained in each mode is unaltered by the energy contained in other modes, and the modes may propagate simultaneously at the same frequency without experiencing mutual interference. In cases where a sufficient number of waveguide modes are excited, the signal amplitude transmitted by each coupling probe may be computed through suitable measurements of the total electromagnetic field resulting from the supposition of the waveguide modes. The use of the waveguide modes in this manner may thus be analogized to the application of spatial multiplexing in open signal environments, allowing the simultaneous transmission of information within multiple communication channels at the same frequency.

FIG. 1 illustrates a portion of a wireless heating, ventilation, and air conditioning (HVAC) duct transmission system 10 according to one embodiment of the present invention. Communication signals and air are transmitted through an HVAC duct 12, which acts as a waveguide for the communication signals. The duct 12 exhibits those properties that are common to waveguides. The properties are detailed in R. Collin, "Field Theory of Guided Waves," 2d ed., IEEE, Press, N.Y. 1991, which is incorporated herein by reference. The system 10 can utilize any HVAC duct of any shape commonly used in structures, including, for example, cylindrical HVAC ducts and rectangular HVAC ducts. The HVAC duct 12 can also be constructed of any type of electrically reflecting material, such as, for example, sheet metal or foil-lined insulation.

A plurality of transmitter devices 14*a*, 14*b* comprising a transmitter array 14 are inserted into the HVAC duct 12. The transmitter array 14 transmits communication signals through the HVAC duct 12. In one embodiment, each of the transmitter devices 14*a*, 14*b* may be a coaxial to waveguide probe with its inner conductor extending into the duct 12. However, it can be understood that each transmitter device 14*a*, 14*b* may be any type of transmitter capable of injecting electromagnetic energy into a waveguide such as, for example, an end-fed probe antenna, an end-fed loop antenna, or a transmission line fed waveguide probe antenna. Coaxial cables 14*c*, 14*d* attached to each transmitter device 14*a*, 14*b* supply the communication signals that are to be transmitted through the HVAC duct 12. The transmitter array 14 may be located at a central point in the HVAC duct system of which the HVAC duct 12 is a part. For instance, HVAC duct systems often branch out from a larger central duct. The transmitter array 14 may be located in the larger central duct so that the communication signals are distributed throughout the entire HVAC duct system. The transmitter array 14 may also be located at any point in the HVAC duct system that is necessary or that is readily accessible.

The system 10 of FIG. 1 further includes a receiver array 15 comprised of a plurality of receiver devices 15*a*, 15*b* that are inserted into the HVAC duct 12. The receiver array 15 receives the communication signals transmitted by the transmitter array 14. Each receiver device 15*a*, 15*b* may be any type of signal receiver, such as, for example, an antenna or coupler probe that couples the communication signals to a coaxial cable or wire. Coaxial cables 15*c*, 15*d* are attached to each transmitter device 15*a*, 15*b* to receive the communication signals that have been transmitted through the HVAC duct 12.

The number and location of the transmitter devices 14*a*, 14*b* and the receiver devices 15*a*, 15*b* of FIG. 1 are shown by way of example only. The actual number and location of each device within the arrays 14, 15 may vary depending upon several factors such as the physical characteristics of the HVAC duct 12 and the channel capacity required for the wireless communication application.

The number of propagating modes excited in the HVAC duct 12 may be a function of the number and location of transmitter devices 14*a*, 14*b* comprising the transmitter array 14. Because the channel capacity of the HVAC duct 12 may be theoretically shown to increase by a factor up to the number of propagating modes, it may be desirable to design the transmitter array 14 to excite the maximum number of modes possible for a given frequency band. Although the physical variables affecting signal propagation in multimode waveguides are well known, the complexity of HVAC duct systems and the presence of physical non-uniformities often make it impractical to design the transmitter array 14 using analytical methods alone. Accordingly, determining the optimal number and location of transmitter devices 14*a*, 14*b* may entail the use of empirical design techniques.

Similarly, the number and placement of the receiver devices 15*a*, 15*b* within the receiver array 15 may be selected to optimize modal coupling between each of the transmitter devices 14*a*, 14*b* and the receiver devices 15*a*, 15*b*. Adequate modal coupling is necessary to ensure that the signal amplitude generated by each of the transmitter devices 14*a*, 14*b* may be computed by measuring the electromagnetic field resulting from the supposition of the waveguide modes at each receiver device 15*a*, 15*b*. It is not necessary that the transmitter devices 14*a*, 14*b* be equal in number to the receiver devices 15*a*, 15*b*.

The gain in channel capacity realized by distributing multiple communication channels among various waveguide modes using multiple transmit coupling probes and multiple detection probes may be demonstrated by example. Consider the case in which a segment of HVAC duct 12 has a transmitter array 14 having two transmitter devices 14*a*, 14*b* generating signal amplitudes of $V_1$ and $V_2$ respectively, and a receiver array 15 having two receiver devices 15*a*, 15*b* generating signal amplitudes of $V_3$ and $V_4$ respectively. In the case of only one propagating mode, the total amplitude of the mode incident on each of the receiver devices may be expressed as:

$$A=\alpha V_1+\beta V_2$$

where $\alpha$ and $\beta$ are the mode amplitudes excited by transmitter devices 14*a* and 14*b* respectively. The signal amplitude generated detected by receiver devices 15*a* and 15*b* may then be written as:

$$V_3=\gamma[\alpha V_1+\beta V_2]$$

$$V_4=\delta[\alpha V_1+\beta V_2]$$

where $\gamma$ and $\delta$ are the mode coupling coefficients of receiver devices 15*a* and 15*b* respectively. Because the above expressions for signal amplitudes $V_3$ and $V_4$ are not linearly independent, it is not possible to combine them to recover signal amplitudes $V_1$ and $V_2$.

Alternatively, consider the case in which two or more different modes propagate in the HVAC duct 12. The total amplitude of each mode incident on each of the receiver devices may be expressed as:

$$A_1=\alpha_1 V_1+\beta_1 V_2$$

$$A_2=\alpha_2 V_1+\beta_2 V_2$$

where $\alpha_1$, $\alpha_2$ and $\beta_1$, $\beta_2$ are the mode amplitudes excited by transmitter devices 14*a* and 14*b* respectively. The signal amplitude detected by receiver devices 15*a* and 15*b* may then be written as:

$$V_3=\gamma_1A_1+\gamma_2A_2=(\gamma_1\alpha_1+\gamma_2\alpha_2)V_1+(\gamma_1\beta_1+\gamma_2\beta_2)V_2$$

$$V_4=\delta_1A_1+\delta_2A_2=(\delta_1\alpha_1+\delta_2\alpha_2)V_1+(\delta_1\beta_1+\delta_2\beta_2)V_2$$

where $\gamma_1$, $\gamma_2$ and $\delta_1$, $\delta_2$ are the mode coupling coefficients of receiver devices 15*a* and 15*b* respectively. Because the above expressions for signal amplitudes $V_3$ and $V_4$ are no longer linearly dependent, they may be inverted to yield:

$$V_1=(DV_3-BV_4)\div(AD-BC)$$

$$V_2=(CV_3-AV_4)\div(BC-AD)$$

where:

$A=\gamma_1\alpha_1+\gamma_2\alpha_2$ $B=\gamma_1\beta_1+\gamma_2\beta_2$ $C=\delta_1\alpha_1+\delta_2\alpha_2$ $D=\delta_1\beta_1+\delta_2\beta_2$ Accordingly, it is seen that in the case of two propagating modes, two channels may be simultaneously transmitted between the transmitter devices 14*a*, 14*b* and the receiver devices 15*a*, 15*b*. It may thus be shown that the channel capacity of the HVAC duct 12 may be increased by a factor up to the number of propagating modes in the duct. Although the channel capacity of the HVAC duct 12 may be increased if the transmitter devices 14*a*, 14*b* excite different frequencies, an equivalent result would be obtained by feeding multiple frequencies into a single wide-bandwidth probe. The use of multiple modes within the same frequency band, however, requires no additional bandwidth and thus has the benefit of increasing spectral efficiency.

Because the impedance of the transmitter array in the duct 12 is different from that in free space, impedance matching may be performed analytically or empirically to determine the transmission characteristics of the transmitter array 14. It can be understood that either analytical or empirical determinations can be used to ascertain not only the transmission characteristics of the transmitter array 14, but also the necessity and location of any amplifiers or re-radiators in the duct 12.

In order to distribute data channels from multiple sources between the transmitter devices 14*a*, 14*b*, the system 10 may include a distribution circuit 18 for merging the data channels into a series of data streams corresponding in number to that of the transmitter devices 14*a*, 14*b* and for processing each data stream to generate a corresponding communication signal suitable for wireless transmission. The distribution circuit 18 may then combine the modulated data streams for transmission to each transmitter device 14*a*, 14*b* via coaxial cables 14*c*, 14*d*. Similarly, the system 10 may further include a combination circuit 20 for receiving communication signals from each of the receiver devices 15*a*, 15*b* via coaxial cables 15*c*, 15*d* and recovering the data channels therefrom.

In the arrangement described above, increased channel capacity is obtained by creating a separate modulated signal for each data channel and then adding the modulated signals with different weights to supply to each device 14*a*, 14*b* in the array 14. The arrangement effectively places one data channel on each "mode channel." In one embodiment, carrier technologies such as, for example, TDMA, CDMA, and GSM can be used to place multiple data channels on each "mode channel."

Figure 2:
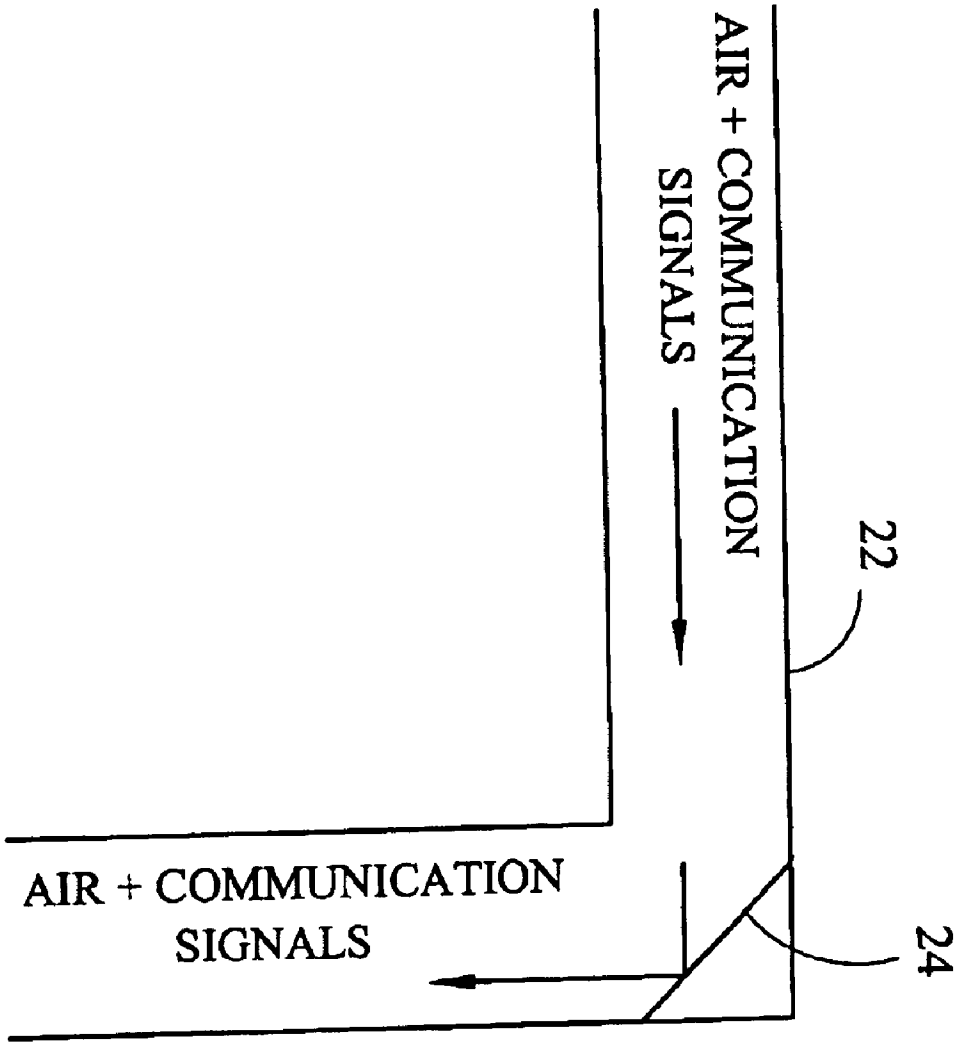
FIG. 2 is a diagram illustrating an electrically opaque reflector sheet located in a portion of an HVAC duct.

FIG. 2 illustrates a portion of an HVAC duct 22 with an electrically opaque reflector sheet 24 located at a point where the duct 22 changes direction. The sheet minimizes reflection of the communication signals due to the change in direction of the duct 22. It can be understood that the sheet 24 can be located anywhere in the duct 22 where there is a change in direction of the duct 22. For example, the sheet 24 could be located at a branch point in the duct 22 or at a turn in the duct 22. The sheet 24 reflects the communication signals in a direction that follows the direction of the duct 22. The sheet 24 does not interfere with the flow of air in the duct 22 because the flow will be deflected in the direction of the duct 22. If the change in direction of the duct 22 were a branch point, the branch point would function as a power splitter. An iris constructed of, for example, wire screen, could be inserted at the branch to ensure the desired power division at the branch.

Figure 3:
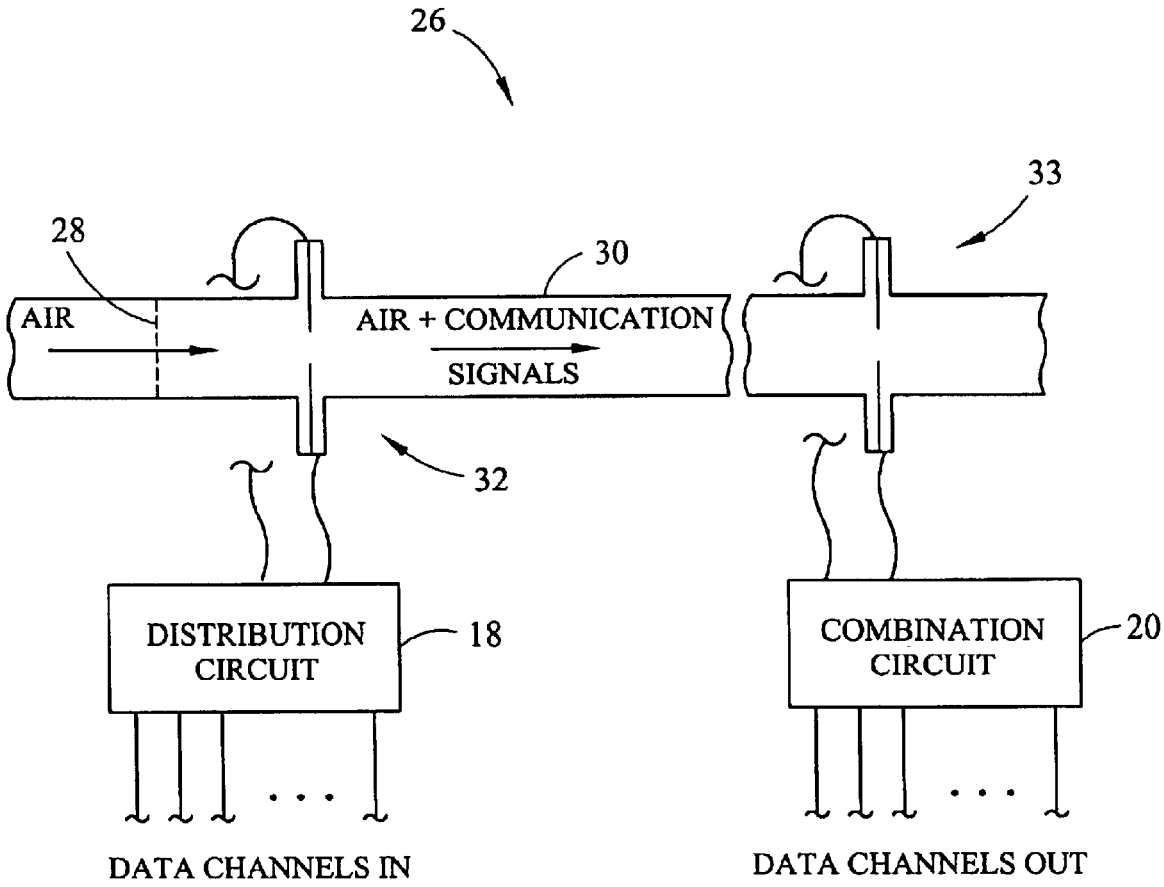
FIG. 3 is a diagram illustrating another embodiment of a wireless HVAC duct transmission system with a wire screen ground plane located in the duct.

FIG. 3 is a diagram illustrating another embodiment of a wireless HVAC duct transmission system 26 with a wire screen ground plane 28 located in an HVAC duct 30 adjacent to a transmitter array 32. The ground plane 28 is located in a position such that it prevents the communication signals transmitted from the transmitter array 32 from being transmitted to the left as shown in FIG. 3. As shown in FIG. 3, the ground plane 28 passes the air that flows through the duct 30. It can be understood that the ground plane 28 can be constructed of any type of material that is electrically opaque but can still pass air, such as, for example, a grounded wire screen. The ground plane 28 not only achieves unidirectional propagation of the communication signals, but also facilitates matching the impedance of the transmitter array 32 with the impedance of the duct 30.

Figure 4:
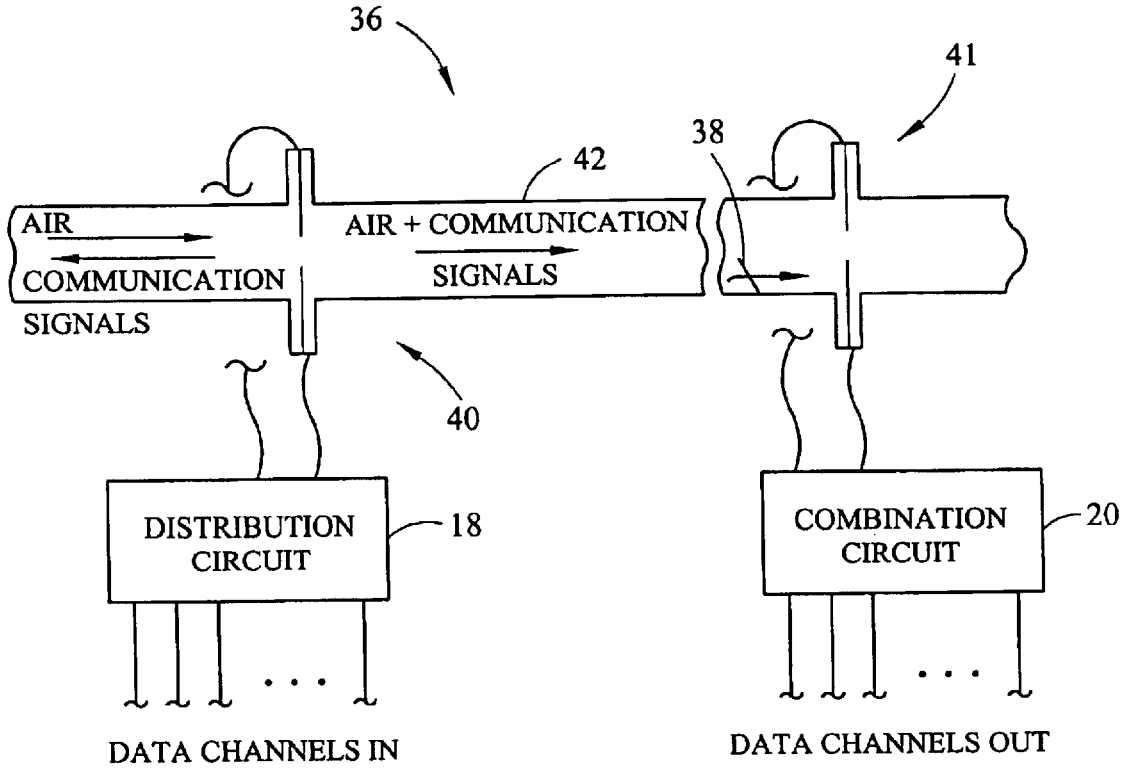
FIG. 4 is a diagram illustrating another embodiment of a wireless HVAC duct transmission system with an electrically translucent damper.

FIG. 4 is a diagram illustrating another embodiment of a wireless HVAC duct transmission system 36 with an electrically translucent damper 38 located in an HVAC duct 42. The damper 38 is used to deflect air while permitting the communication signals to pass through. It can be understood that the damper 38 can be constructed of any type of material that is electrically translucent but cannot pass air, such as, for example, plastic.

Figure 5:
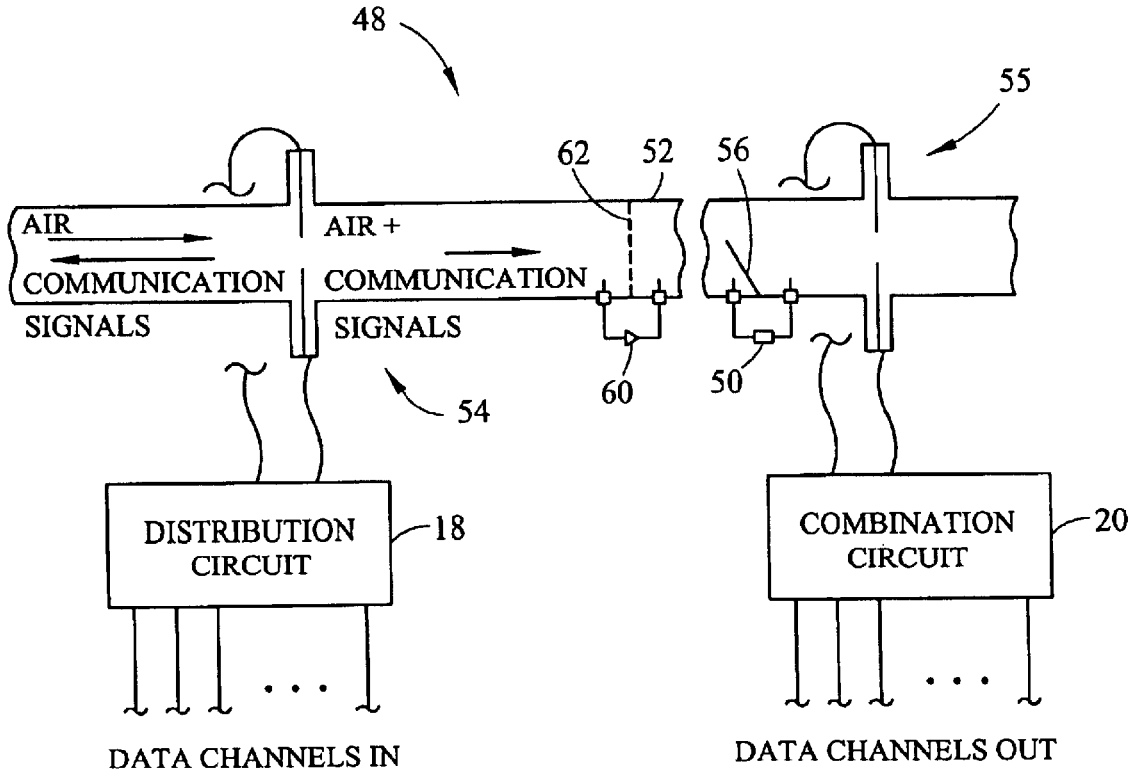
FIG. 5 is a diagram illustrating another embodiment of a wireless HVAC duct transmission system with an amplified or passive re-radiator.
Figure 6:
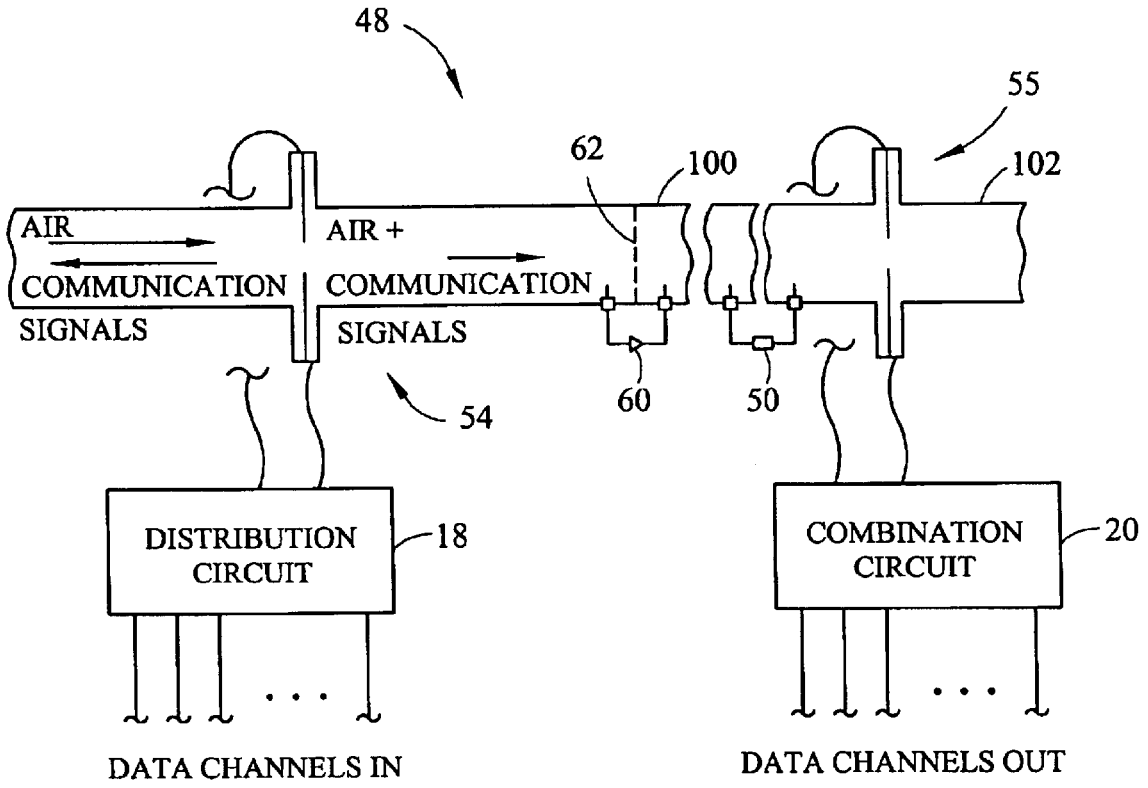
FIG. 6 is a diagram illustrating another embodiment of a wireless HVAC duct system with an amplified or passive re-radiator between two HVAC duct systems.

FIG. 5 illustrates another embodiment of a wireless HVAC duct transmission system 48 with a passive or amplified re-radiator array 50 located in an HVAC duct 52. The re-radiator array 50 may have multiple receiver devices and transmitter devices. A transmitter array 54 transmits communication signals into the duct 52. A damper 56, which is electrically opaque, blocks the transmission of the communication signals beyond the damper 56. The re-radiator array 50 receives the communication signals and re-transmits them beyond the damper 56, where they may be detected by a receiver array 55. Thus, the air flow out of the duct 52 is blocked, either partially or entirely depending on the position of the damper 56, while the communication signals are permitted to propagate beyond the damper 56. It can be understood that passive or amplified re-radiator array 50 can be located anywhere in the duct 52 where transmission past an opaque or attenuating obstruction is necessary. Furthermore, it can be understood that passive or amplified re-radiator arrays 50 can be used to receive communication signals from one system of HVAC ducts for retransmission into another HVAC duct system that does not have a direct mechanical connection with the first HVAC duct system. FIG. 6 illustrates such an arrangement in which the re-radiator array 50 can transmit from one system of HVAC ducts 100 into another HVAC duct system 102.

A booster amplifier array 60 is located in the duct 100 to receive, amplify, and re-radiate the communication signals in the duct 100. The booster array 60 may have multiple receiver devices and transmitter devices. The booster array 60 can be used if the duct 100 has a high attenuation level and the communication signals must be retransmitted at a higher signal level. A screen 62 is also positioned in the duct 100. The screen 62 is constructed such that air can pass through the screen 62. For example, the screen 62 can be a wire screen having a directional receiving coupler on one side and a directional transmitting coupler on the other side.

While the present invention has been described in conjunction with preferred embodiments thereof, many modifications and variations will be apparent to those of ordinary skill in the art. For example, absorbers could be placed inside the HVAC ducts to minimize multiple reflections of the communications signals. Such absorbers could be constructed of, for example, foam. Also, although the present invention has been described in conjunction with electromagnetic radiation communication signals, it can be understood by those skilled in the art that the present invention could be used to transmit many types of electromagnetic radiation such as, for example, RF waves and microwaves in many types of applications, including but not limited to communication systems. The foregoing description and the following claims are intended to cover all such modifications and variations.

What is claimed is:

1. A system for transmitting wireless communications within ductwork, comprising:

a plurality of transmitter devices for introducing electromagnetic radiation into the ductwork such that the ductwork acts as a waveguide for the electromagnetic radiation, said transmitter devices comprising a transmitter array, wherein the transmitter devices are configured to introduce the electromagnetic radiation using multiple propagation modes;

a plurality of receiver devices for detecting the electromagnetic radiation within the ductwork, said receiver devices comprising a receiver array; and a distribution circuit in communication with the transmitter array for merging the contents of one or more data channels into a plurality of data streams for processing the data streams to generate corresponding communication signals suitable for wireless transmission, and for transmitting the communication signals to the transmitter array.

2. The system of claim 1, wherein said transmitter devices for introducing include coaxial to waveguide probes.

3. The system of claim 1, wherein said transmitter devices for introducing include antennas.

4. The system of claim 1, wherein said receiver devices for detecting include coaxial to waveguide probes.

5. The system of claim 1, wherein said receiver devices for detecting include antennas.

6. The system of claim 1, further comprising a re-radiator array positioned to re-radiate electromagnetic radiation around an obstacle.

7. The system of claim 6, wherein said re-radiator array includes a passive re-radiator.

8. The system of claim 6, wherein said re-radiator array includes an active re-radiator.

9. The system of claim 1, further comprising an electrically opaque reflector located at a point in the ductwork where the ductwork changes direction, said reflector for reflecting the electromagnetic radiation in a direction following the direction of the ductwork.

10. The system of claim 9, wherein said reflector is a metal sheet.

11. The system of claim 9, wherein said reflector is a wire grid.

12. The system of claim 1, further comprising a wire screen ground plane located in the ductwork adjacent to said transmitter array.

13. The system of claim 1, further comprising an electrically translucent damper located in the ductwork, said damper for deflecting air flow in the ductwork.

14. The system of claim 1, further comprising an absorber located in the ductwork, said absorber for minimizing multiple reflections of said electromagnetic radiation.

15. The system of claim 1, further comprising an amplifier array positioned to re-radiate the electromagnetic radiation.

16. The system of claim 15, wherein said amplifier array includes a booster amplifier.

17. The system of claim 15, wherein said amplifier array includes a directional receiving coupler, a directional transmitting coupler, and an electrically opaque screen interposed between said couplers.

18. A system for transmitting wireless communications within ductwork, comprising:

means for introducing electromagnetic radiation into the ductwork such that the ductwork acts as a waveguide for the electromagnetic radiation, said means for introducing comprising a transmitter array, wherein the transmitter array is configured to introduce the electromagnetic radiation using multiple propagation modes;

means for detecting the electromagnetic radiation within the ductwork, said means for detecting comprising a receiver array; and means for merging the contents of one or more data channels into a plurality of data streams, for processing the data streams to generate corresponding communication signals suitable for wireless transmission, and for transmitting the communication signals to the transmitter array.

19. A method for transmitting wireless communications within ductwork, comprising:

introducing electromagnetic radiation into the ductwork using a plurality of transmitter devices such that the ductwork acts as a waveguide for the electromagnetic radiation, said transmitter devices comprising a transmitter array, wherein the transmitter array is configured to introduce the electromagnetic radiation using multiple propagation modes;

detecting the electromagnetic radiation using a plurality of receiver devices within the ductwork, said receiver devices comprising a receiver array;

merging the contents of one or more data channels into a plurality of data streams;

processing the data streams to generate corresponding communication signals suitable for wireless transmission; and transmitting the communication signals to the transmitter array.

20. A system for transmitting wireless communications within ductwork, comprising:

a plurality of transmitter devices for introducing electromagnetic radiation into the ductwork such that the ductwork acts as a waveguide for the electromagnetic radiation, said transmitter devices comprising a transmitter array, wherein the transmitter devices are configured to introduce the electromagnetic radiation using multiple propagation modes;

a plurality of receiver devices for detecting the electromagnetic radiation within the ductwork, said receiver devices comprising a receiver array; and a combination circuit for receiving communication signals from the receiver array, for processing the communication signals to generate a plurality of data streams, and for extracting from the data streams one or more data channels.

21. A system for transmitting wireless communications within ductwork, comprising:

means for introducing electromagnetic radiation into the ductwork such that the ductwork acts as a waveguide for the electromagnetic radiation, said means for introducing comprising a transmitter array, wherein the transmitter array is configured to introduce the electromagnetic radiation using multiple propagation modes;

means for detecting the electromagnetic radiation within the ductwork, said means for detecting comprising a receiver array; and means for receiving communication signals from the receiver array, for processing the communication signals to generate a plurality of data streams, and for extracting from the data streams one or more data channels.

22. A method for transmitting wireless communications within ductwork, comprising:

introducing electromagnetic radiation into the ductwork using a plurality of transmitter devices such that the ductwork acts as a waveguide for the electromagnetic radiation, said transmitter devices comprising a transmitter array, wherein the transmitter array is configured to introduce the electromagnetic radiation using multiple propagation modes;

detecting the electromagnetic radiation using a plurality of receiver devices within the ductwork, said receiver devices comprising a receiver array;

receiving communication signals from the receiver array;

processing the communication signals to generate a plurality of data streams; and extracting from the data streams one or more data channels.

* * * * *